US005731033A

United States Patent [19]

Hanisco

[11] Patent Number: 5,731,033

[45] Date of Patent: Mar. 24, 1998

[54] MEDIUM AND PROCESS FOR MANUFACTURING A STAMP

[76] Inventor: Christine M. Hanisco, 103 Elk Creek Rd., Oxford, Pa. 19363

[21] Appl. No.: 829,111

[22] Filed: Mar. 31, 1997

Related U.S. Application Data

[60] Provisional application No. 60/023,403 Aug. 14, 1996.

[51] Int. Cl.[6] ..... B05D 1/26; B05D 1/36; B05D 5/04

[52] U.S. Cl. ..... 427/256; 427/261; 427/384; 427/429; 118/265

[58] Field of Search ..... 427/256, 429, 427/384, 261; 434/84; 118/265; 101/333, 379, 401.1; 428/909

[56] References Cited

U.S. PATENT DOCUMENTS

| | | | |
|---|---|---|---|
| 3,096,713 | 7/1963 | McLaughlin, Jr. | 101/379 |
| 3,615,450 | 10/1971 | Werber et al. | 96/35.1 |
| 3,903,794 | 9/1975 | Grupe et al. | 101/376 |
| 4,100,853 | 7/1978 | Clancy et al. | 101/401.1 |
| 4,279,674 | 7/1981 | Wadden | 156/62 |

FOREIGN PATENT DOCUMENTS 061654 6/1978 Japan .

OTHER PUBLICATIONS

"Introduction To Ceramics", G. Flight, Prentice–Hall, 1989, pp. 182–183.

*Primary Examiner*—Shrive Beck
*Assistant Examiner*—Fred J. Parker

[57] ABSTRACT

A method of manufacturing a stamp comprises a high-viscosity emulsion composed of at least one synthetic emulsion and/or naturally found emulsion, including but not limited to water-based poly emulsions, acrylic latexes, vinyl acrylic latexes, polyvinyl acetate latexes, vinyl acrylic latex, styrene acrylic latexes, styrene butadiene latexes and polyurethanes. The emulsion(1) is applied to a mounting surface (2), such as a block of wood or synthetic material, in at least one layer over a predetermined design(5) on the surface and allowed to cure, forming a flexible, rubber-type material in the shape of the design(5), suitable for producing a stamp.

12 Claims, 4 Drawing Sheets

MEDIUM AND PROCESS FOR MANUFACTURING A STAMP

TECHNICAL FIELD OF THE INVENTION

This invention is connected to an earlier-filed provisional application 60/023403 and relates in general to the field of rubber or printing stamps, and particularly to a medium and process used in manufacturing such a stamp.

BACKGROUND OF THE INVENTION

Many variations of rubber-type stamps are used for repeatedly applying various inks, pigments, and liquids onto a surface. The majority of these stamps are made of a vulcanized rubber compound or of a photo-sensitive material and are either formed; using a mold, by embossing with lasers, by exposing to ultraviolet rays, or by carving with a scalpel or other sharp instrument. With the exception of the carving method, these stamps are generally mass produced in a factory by a specially trained professional using complex machinery, and require several steps in production.

Manufacturing a stamp using the vulcanization technique includes preparing camera-ready art, developing a negative film of the art, tooling and preparing a mold, melting a rubber compound at a very high temperature, pouring it into the mold, curing and trimming the rubber compound, and mounting the solid rubber compound onto a cushioning layer and then onto a mounting surface, such as a block of wood.

Manufacturing a stamp using the laser technique includes preparing camera-ready art, scanning the art electronically, preparing a rubber compound that the design will be cut out of, and embossing a relief pattern into the rubber compound using laser beams.

Manufacturing a stamp using the photo emulsion technique includes preparing camera-ready art, developing a negative film of the art, placing the film over a photo-sensitive emulsion, exposing the emulsion to ultraviolet rays thereby causing the exposed design area to harden, and disposing of the underexposed emulsion leaving a raised surface in the shape of the desired design.

Manufacturing a stamp using the carving technique includes drawing a design on a piece of rubber or a rubber eraser and cutting the areas outside of the design area with a very sharp knife or scalpel leaving a raised surface in the shape of the desired design.

Should a person want a stamp bearing his or her own design, it must be sent to a factory to be manufactured using one of the above techniques, which can be very expensive and time consuming, and often employs the use of dangerous chemicals, contact with noxious fumes, and presents the possibility of being burned—chemically or by heat.

Alternatively the person can carve the design, but this is extremely dangerous, especially for children, due to the possibility of incurring a laceration.

In particular, all of the methods of making a stamp heretofore known suffer from a number of disadvantages:

(a) Creating an original, one-of-a-kind, stamp using the vulcanization method is very costly and time consuming. It is generally not cost or time-effective to create a stamp of original nature due to the steps and the machinery involved. The method of vulcanization involves heating rubber to it's melting point, which is dangerous due to the possibility of a person being burned. It is a fire hazard and emits poisonous oases, and therefore is not likely to be used in a home or school. It also requires complicated machinery and people with special training and skills to operate such machinery. Additionally, it employs the use of a mold, which must be tooled before the rubber mixture is applied. Once the rubber compound is cured and trimmed of imperfections, it is mounted onto a piece of foam for cushioning, and then to a mounting surface.

(b) Manufacturing an original, one-of-a-kind stamp with the laser technique requires extremely expensive laser emitting devices, which most likely would not be used in a home or school, and is time consuming and complicated. It is a method that requires several steps using complex machinery. Special training and skills are required to operate such machinery, in that the use of lasers is certainly dangerous for the average person. Additionally, laser-embossed stamps must be cut out of a rubber compound, which inevitably would be created by the vulcanization method, therefore adding more disadvantages. Once etched by the lasers, the finished piece is mounted onto a piece of foam for cushioning, and then to a mounting surface.

(c) Making a stamp using the photo emulsion technique requires several complex steps, as well as expensive equipment. A negative image of the desired design is placed over a photo-sensitive emulsion and cured with an ultraviolet light, which hardens exposed areas. This technique uses toxic chemicals, and it is a well known fact that ultraviolet light is a form of radiation and should be avoided as it can cause damage to the eyes and skin, and has been linked to skin cancer. It is highly unlikely that this method could be used in the home or in a school. Additionally, this method requires special training and skills. Once the emulsion is cured, it is generally mounted on a foam cushion and then onto a mounting surface.

(d) Creating a stamp by carving it from a rubber compound is time-consuming and dangerous. The possibility of inflicting a laceration on oneself or another person is eminent. This method is certainly unsafe for children. Additionally, carved stamps must be cut out of a rubber compound, which inevitably would be created by the vulcanization method, thereby adding more disadvantages.

OBJECTS AND ADVANTAGES

Accordingly several objects and advantages of this invention are to provide an improved method of manufacturing a stamp; which allows a consumer to create an original, one-of-a-kind stamp in the home; to provide such a method that is very safe to use, especially for children; which can be manufactured to be non-toxic, water-soluble, and does not require the element of heat or toxic chemical reactions to form a stamp.

Other advantages are to provide such a method which is fast in curing, allowing a stamp to be manufactured in an hour or two, as compared to days or weeks when manufactured elsewhere or created using existing processes; which is easier to use; which allows the consumer to produce a one-of-a-kind rubber-type stamp at a fraction of the cost if manufactured differently; which allows additives such as a tint or pigment to be added to allow the consumer to better view the design while manufacturing the stamp; which allows for easy clean-up with water; which allows the addition of fragrance for user appeal; which does not rely upon the use of a mold, thus decreasing cost and labor; which exhibits a color change, such as turning transparent, when the emulsion is done curing, serving as a signal that the stamp is ready for use; which allows more than one side of a mounting surface to be used for a stamp, thus saving money; which allows a stamp to be made without the use of a foam cushion between the stamp and the mounting surface, thus reducing cost: which allows a stamp to be created on any suitably-shaped mounting surface: which allows the consumer total freedom in creativity and the ability to manufacture a one-of-a kind item: which uses a very small and portable apparatus, compared to the large machinery currently used to make stamps; which provides a simplified method for creating a stamp without the complication of machinery; and which allows the user to create a stamp without any lengthy training or special skill, as would be needed to work complex machinery.

Additionally, the present invention could be packaged in a small, inexpensive kit containing; an applicator holding an emulsion used to create a stamp, a predetermined number of wooden or synthetic blocks to be used as a mounting surface for the emulsion, instructions, and a drawing or tracing device such as a stencil or tracing paper to aid non-artistic users.

SUMMARY

The invention discloses a simple and an improved method of manufacturing a stamp that can be done at home, even by a child. A manufacturing kit is provided that contains a non-toxic, high viscosity emulsion comprising a combination of at least one synthetic substance and/or naturally found substance including the following groups: polymers, acrylic latexes, vinyl acrylic latexes, polyvinyl acetate latexes, styrene acrylic latexes, styrene butadiene latexes and polyurethanes, that is water soluble in the non-cured state, yet water-proof and non-tacky in it's cured state. The method involves applying with a kit-provided applicator, the emulsion in a layering fashion onto any solid base material such as wood, plastic, fiberglass, metal or combination thereof, until a predetermined thickness is achieved. The high viscosity nature of the composition allows for any desired design to be formed. After the desired design is formed, the emulsion is allowed to cure by air, and, is completed when it changes from an opaque coloration to a transparent one. The final product has a solid, yet flexible, rubber-like consistency that may then be used as a stamp.

Other objects include; a safe, inexpensive method of manufacturing a unique and one-of-a-kind stamp using small and portable apparatus' without any special training or use of complicated machinery;

- a method of manufacturing a stamp which is fast in curing, and does not require the element of heat or toxic chemical reactions;
- a method of manufacturing a stamp which does not rely upon the use or added expense of a mold;
- a method of mounting a stamp on any or all sides any suitably shaped surface without the use of a foam cushion between the cured emulsion and the mounting surface;
- an addition of a coloring pigment to the emulsion to aid the user in viewing the application of the emulsion onto the mounting surface, and the addition of fragrance for user appeal.

DETAILED DESCRIPTION OF THE PREFERRED EMBODIMENTS

Figure 1:
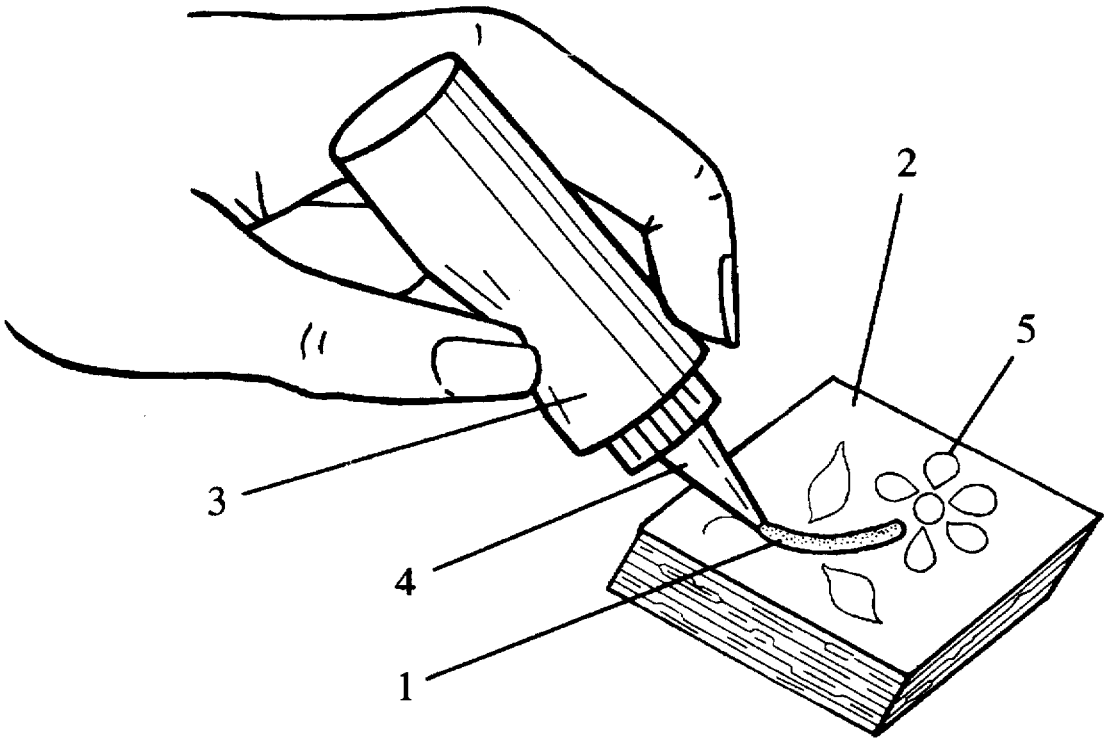
FIG. 1 shows an emulsion of the present invention being implemented to create a stamp.

In order to fabricate a stamp in accordance with the invention, FIG. 1 depicts a mounting surface2, preferably a wooden or synthetic block, with a design5 drawn onto one side by the user using ink or graphite. The user then takes an applicator3 containing an emulsion1 and applies a squeezing motion to cause emulsion1 to flow out of the applicator3, through the applicator's3 nozzle4, and onto the side of mounting surface2 following design5. FIG. 1 illustrates in particular, the application of emulsion1 onto the stem of a flower design5.

Emulsion1 comprises a water-based, clear-drying, non-toxic, flexible polymer with a drying time of less than 1 hour at room temperature.

With reference to FIG. 1 in manufacturing a stamp of the present invention, the following steps have been found advantageous:

1. Combine a predetermined amount of predetermined chemical products, to create an emulsion1 which when cured, takes on flexing properties similar to rubber, such as a water-based, transparent-curing, non-toxic, acrylic polymer with a drying time of less than 12 hours at room temperature.

2. If desired add a tint or pigment to the mixture to allow for better visibility and aesthetic appeal, such as a pink pigment to simulate the color of pink rubber.

3. Screw nozzle4 onto the opening of applicator3.

4. Using a marking instrument such as a pencil or pen, sketch desired design5 onto one side of mounting surface2, such as a block of wood.

5. Carefully apply emulsion1 to side of mounting surface2 by squeezing applicator3 allowing emulsion1 to flow through nozzle4 and onto side, while following the marks of entire design5 as evenly as possible.

6. Allow emulsion1 to cure for 5 minutes or more.

7. Carefully apply a second layer of emulsion1 over the first layer and allow to dry at least five minutes. Repeat this step until a total of two or more layers have been achieved, bringing the entire height of the layers of emulsion1 to approximately 2 mm to 4 mm above side of mounting surface2 marked by design5 or of enough height to allow an imprint of the finished design without the mounting surface coming in contact with the printable surface.

8. Allow emulsion1 to cure one to two hours or until it exhibits a complete, even color change to a darker, transparent version of the pigment of the non-cured emulsion.

9. Using an liquid-soaked stamp pad or other means of applying pigment to a stamp, press mounting surface2 with the cured emulsion1 down onto the pad, allowing emulsion1 to receive some of the liquid.

10. Press mounting surface2 with emulsion1 holding the pigment, onto a printable surface, such as paper, to create a mark.

Figure 2:
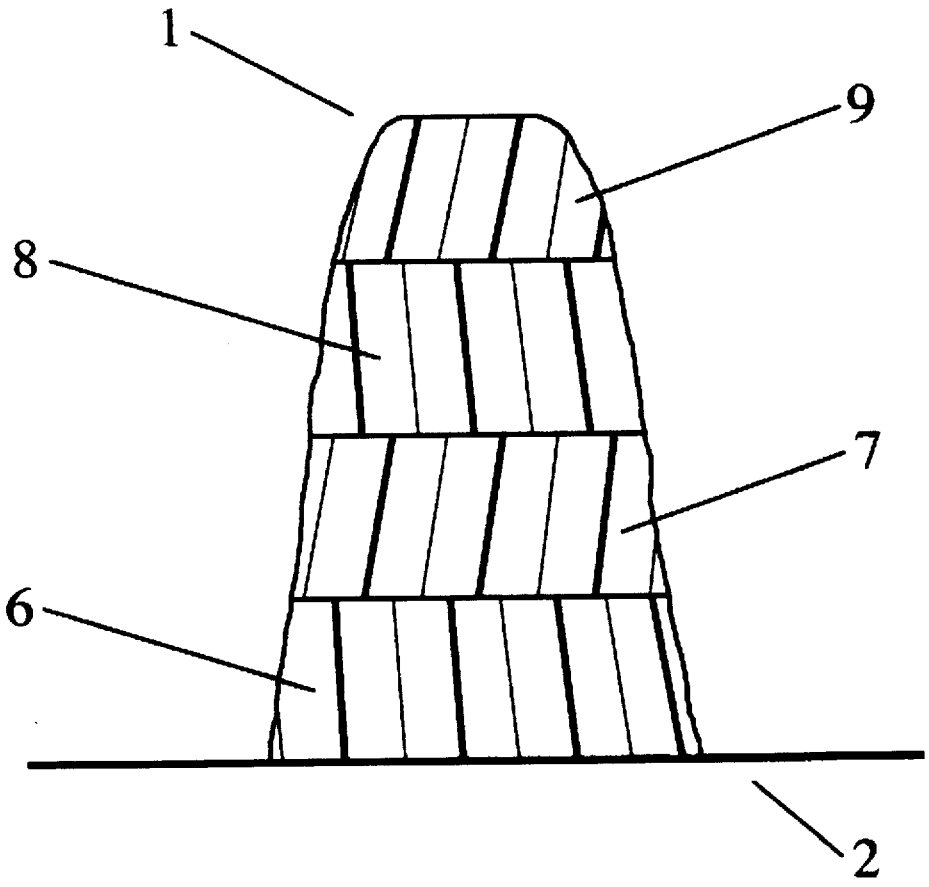
FIG. 2 shows a cross-section of how layers of the emulsion are used to build a stamp to a desired height.

FIG. 2 is a cross-sectional view of emulsion1 after application to mounting surface2, showing four layers (6–9) of emulsion1 used to build a stamp to the desired height.

With reference to FIG. 2 in manufacturing a stamp of the present invention, the following steps show how a stamp's height is created by the application of layers of emulsion1. Layer6 is the first to be applied to mounting surface2 in the shape of a predetermined design (shown in FIG. 1). After allowing layer6 to cure for at least five minutes, layer7 is then applied over entire layer6 and allowed to cure for a minimum of five minutes. Layer8 is then applied over layer7 in the same manner, and layer9 is applied over layer8. Once the desired height is reached, the emulsion is cured until a color change is evident throughout the entire emulsion.

More layers may be added to build the stamp to a desired height, which is generally 1 mm to 6 mm, or enough height to allow an imprint of the finished design onto a printable surface without the mounting surface coming in contact with the printable surface. A stamp can be built using one to any plurality of layers depending on the thickness of the emulsion, the size of the applicator nozzle, the effect desired by the user, and the amount of force the user applies to the applicator.

Figure 3:
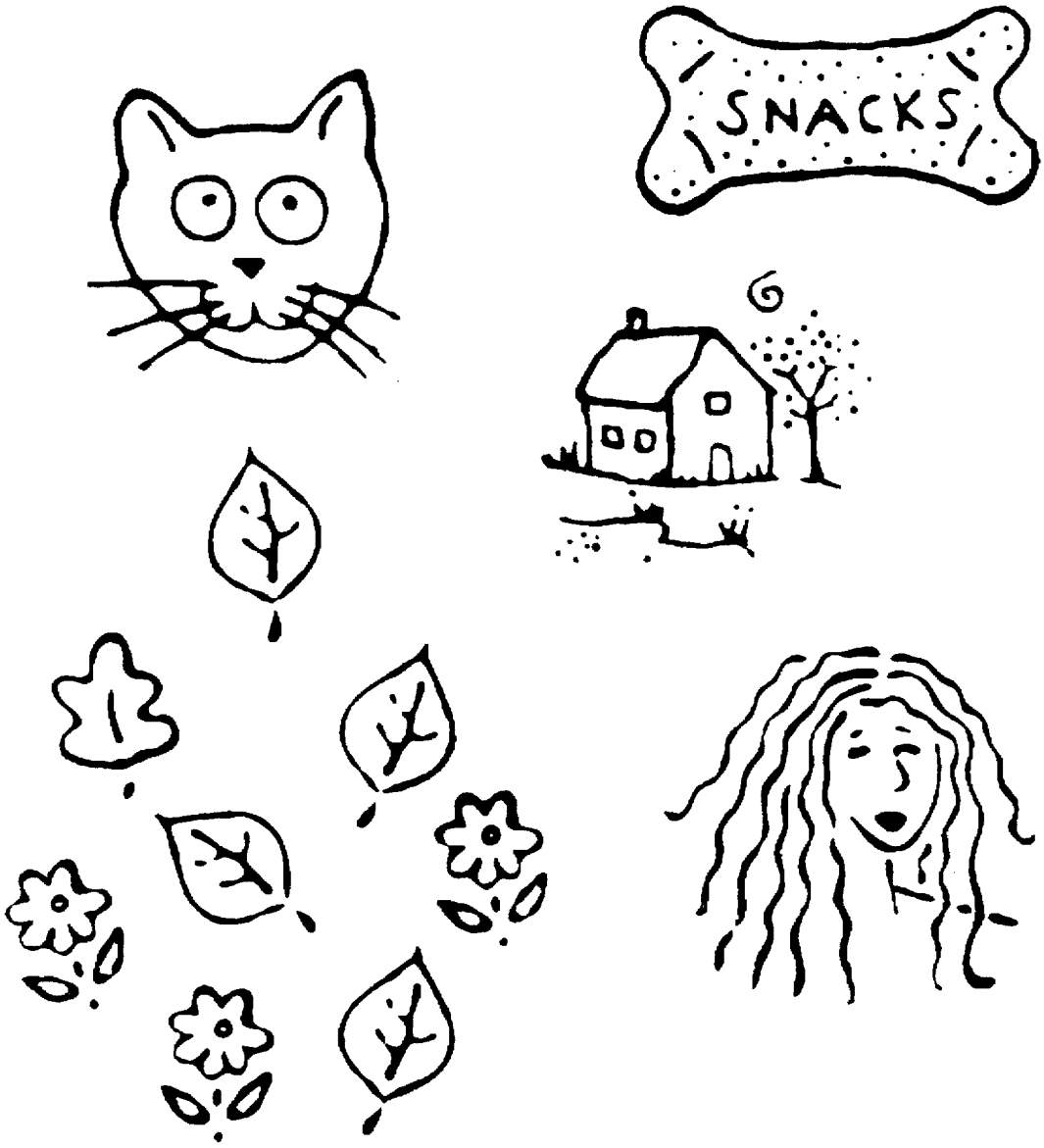
FIG. 3 is an impression sample of the present invention.

FIG. 3 is an impression sample of the present invention showing five of the many designs that can be achieved. FIG. 3 also depicts the use of text on a stamp.

Figure 4:
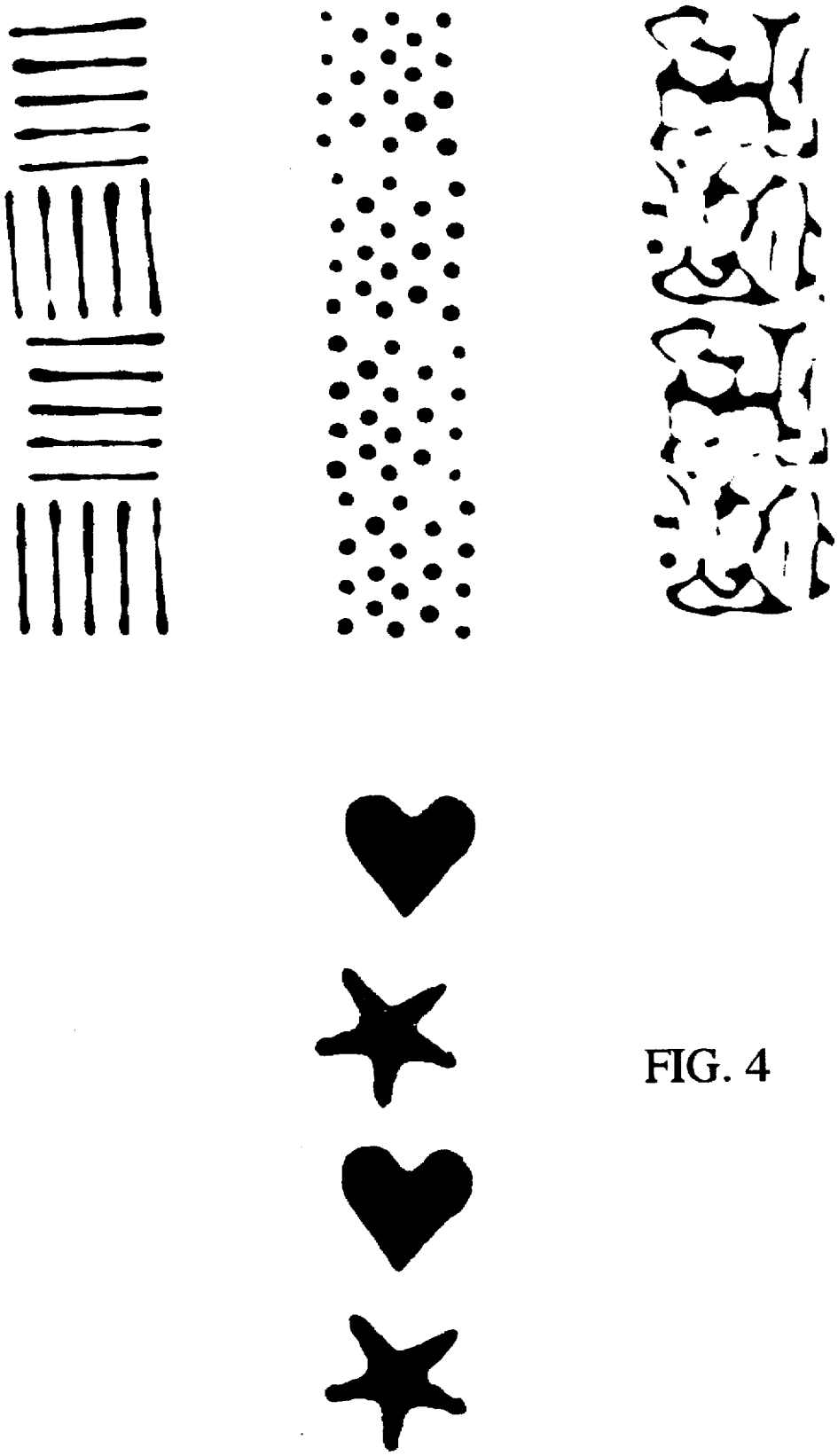
FIG. 4 is an impression sample of the present invention.

FIG. 4 is an impression sample of the present invention showing four of the many special effect and border stamps that can be achieved. FIG. 4 also depicts an impression created by the use of large, spread-out layers, thereby creating an impression that is of a solid appearance.

As will be apparent to those skilled in the art in the light of the foregoing disclosure, many alterations and modifications are possible in the practice of this invention without departing from the spirit and scope thereof. For example, emulsion can be comprised of any liquid or gel having flexible qualities; mounting surface can be wood, plastic, or any surface suitable for receiving the emulsion; mounting surface can be that other than a block, such as a roller or a sphere; emulsion can be cured by different means; curing time can differ; amount of layers can be changed; height of layers can be changed; the addition of a pigment or fragrance can be omitted; and emulsion can be manufactured to be opaque.

Accordingly, the scope of the invention should be construed in accordance with the substance defined by the following claims and their legal equivalents.

I claim:

1. A method of manufacturing an impressing stamp comprising the steps of:

(a) providing an emulsion composition;

(b) applying said emulsion composition by hand onto a solid mounting surface in a pattern;

(c) repeating step (b) until a thickness sufficient to allow an imprint of the pattern, without the mounting surface coming in contact with receiving surface is achieved; and (d) causing said emulsion composition to cure in air, wherein said curing causes said emulsion composition on said substrate to solidify yet remain flexible and rubber-like in said pattern to permit applying a liquid pigment to said cured emulsion pattern, and repeatedly impressing said pattern to transfer said pattern onto a receiving surface.

2. The method of claim 1 wherein said emulsion composition is a naturally found substance, synthetic substance, or mixture thereof.

3. The method of claim 2 wherein said synthetic substance selected from the group consisting of latexes, polyurethanes, and mixtures thereof.

4. The method of claim 3 wherein latexes are selected from the group consisting of acrylic latexes, vinyl acrylic latexes, polyvinyl acetate latexes, styrene acrylic latexes, and styrene butadiene latexes.

5. The method of claim 1 wherein said naturally found substance is a resin.

6. The method of claim 1 wherein said solid mounting surface is made from one or more materials selected from the group consisting of wood, plastic, fiberglass, metal, and combinations thereof.

7. The method of claim 1 wherein said emulsion composition contains a coloring pigment.

8. The method of claim 1 wherein said emulsion composition contains a fragrance.

9. The method of claim 1 wherein said emulsion composition exhibits a color change during said curing step.

10. The method of claim 9 wherein said color change comprises the curing emulsion composition going from being opaque to being transparent.

11. The method of claim 2 wherein said synthetic substance or naturally found substance or mixture thereof, is water-based, non-toxic, and non-photosensitive.

12. A kit for manufacturing an impressing stamp comprising: a container containing an emulsion composition which is flexible when cured, a mounting surface, and an applicator means for applying said emulsion to said mounting surface to form an impressing stamp.

* * * * *